United States Patent [19]

Tarkinson

[11] 4,351,081

[45] Sep. 28, 1982

[54] ABSORBENT PAD AND HOLDER ASSEMBLY FOR CARPET CLEANING

[75] Inventor: Kevork W. Tarkinson, Boynton Beach, Fla.

[73] Assignee: Ann W. Tarkinson, Boynton Beach, Fla.

[21] Appl. No.: 252,954

[22] Filed: Apr. 10, 1981

[51] Int. Cl.[3] ..... A47L 11/283; A47L 13/10

[52] U.S. Cl. ..... 15/210 R; 15/98; 15/230; 15/320

[58] Field of Search ..... 15/208, 209 R, 210 R, 15/228, 230, 230.19, 98, 385, 383, 231, 320

[56] References Cited

U.S. PATENT DOCUMENTS 3,761,991 10/1973 Moss ..... 15/230 X 4,095,303 6/1978 Armstrong ..... 15/230 X

*Primary Examiner*—Edward L. Roberts

*Attorney, Agent, or Firm*—Oltman and Flynn.

[57] ABSTRACT

This invention comprises an absorbent pad unit covered by a coarse mesh screen and mounted on the head of a carpet cleaning device having a handle for manipulating it. The pad has an outer sheet of highly absorbent, acid-resistant paper reinforced with fiberglass strands and located next to the screen, an inner sheet of the same construction, and a relatively thick core of soft, highly absorbent material sandwiched between its outer and inner sheets for absorbing carpet cleaning residue which passes through the outer sheet when the screen rubs against the carpet as the cleaning head is moved across the carpet.

13 Claims, 9 Drawing Figures

ABSORBENT PAD AND HOLDER ASSEMBLY FOR CARPET CLEANING

SUMMARY OF THE INVENTION

This invention relates to an absorbent pad unit and a holder for mounting it on the head of a carpet cleaning apparatus or tool, with a screen on the holder covering the outside of the pad unit for rubbing on the carpet to improve the penetration into the carpet of a previously-applied cleaning solution. The pad unit absorbs cleaning residue from the carpet.

Preferably, the pad unit comprises a soft, relatively thick, highly absorbent core sandwiched between thin outer and inner sheets of acid-resistant, highly absorbent paper reinforced with fiberglass strands. The pad unit is readily replaceable in the holder so that a clean dry pad unit may be substituted for a residue-soaked pad unit whenever desirable.

The present absorbent pad and holder assembly preferably is used in conjunction with a carpet cleaning solution containing an ingredient, such as hydrogen peroxide or carbon dioxide, which produces an effervescing or foaming action when the holder screen covering the absorbent pad is rubbed across carpet to which that cleaning solution has been applied. This effervescing action causes the cleaning solution to penetrate more effectively into the carpet and clean it more completely. Dirt removed from the carpet and the residue of the cleaning solution are absorbed by the pad.

A principal object of the present invention is to provide a novel and improved absorbent pad and screened holder assembly for attachment to the cleaning head of a carpet cleaning apparatus or tool.

Another object of this invention is to provide such a pad and holder assembly for use with a motor-operated floor buffing machine to clean carpet.

Another object of this invention is to provide such a pad and holder assembly for use as part of a manually operated carpet cleaning tool.

Another object of this invention is to provide such a pad and holder assembly for use on the pickup head of a conventional vacuum cleaner to rub a cleaning solution into the carpet and absorb dirt and other cleaning residue from the carpet.

Further objects and advantages of this invention will be apparent from the following detailed description of three presently preferred embodiments, shown in the accompanying drawings.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

FIGS. 1-3

Figure 1:
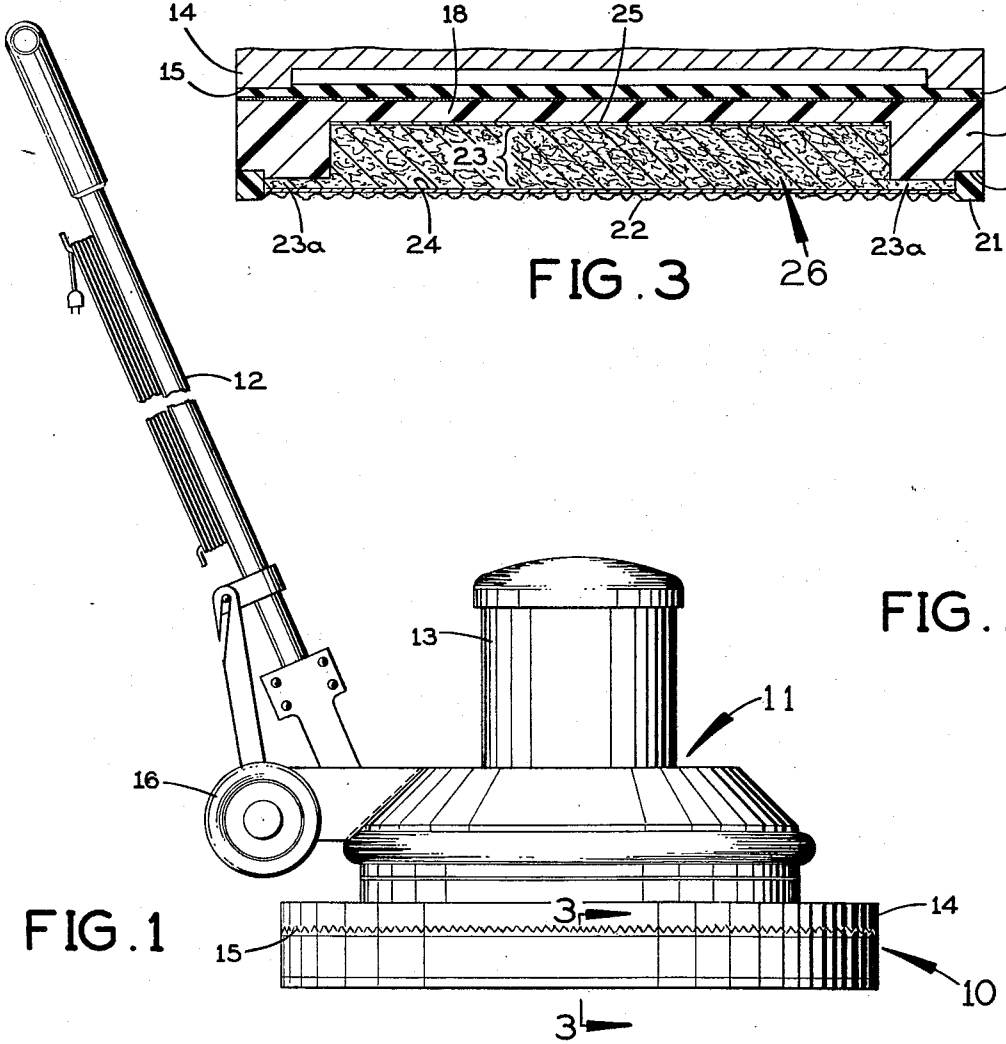
FIG. 1 is a side elevation of an absorbent pad and holder assembly in accordance with the present invention under the cleaning head of a motor-operated floor buffing machine.

As shown in FIG. 1, an absorbent pad and holder assembly 10 in accordance with a first embodiment of the present invention is engaged below the head 11 on the lower end of a floor buffing machine provided with an upwardly inclined handle 12. The buffing machine may be any of several brands of such machines now on the market. The head of the buffing machine carries an electric motor 13 which drives a rotary drive block 14 having a toothed bottom face 15 for frictional engagement with the top of the present pad and holder assembly 10. Normally, as shown, the weight of the motor 13 and the head 11 of the buffing machine rests on the present pad and holder assembly 10. This weight and the frictional engagement between the drive block 14 and the pad and holder assembly 10 are sufficient to impart the motor-driven rotation of the drive block to the pad and holder assembly 10.

The buffing machine has rollers 16 at the lower end of the handle 12 which normally are raised from the floor and do not support the weight of the head 11. By tilting the upper end of the handle 12 down far enough, the head 11 can be raised from the floor and the rollers 16 brought down into engagement with the floor to facilitate moving the buffing machine to or from a working location.

Figure 2:
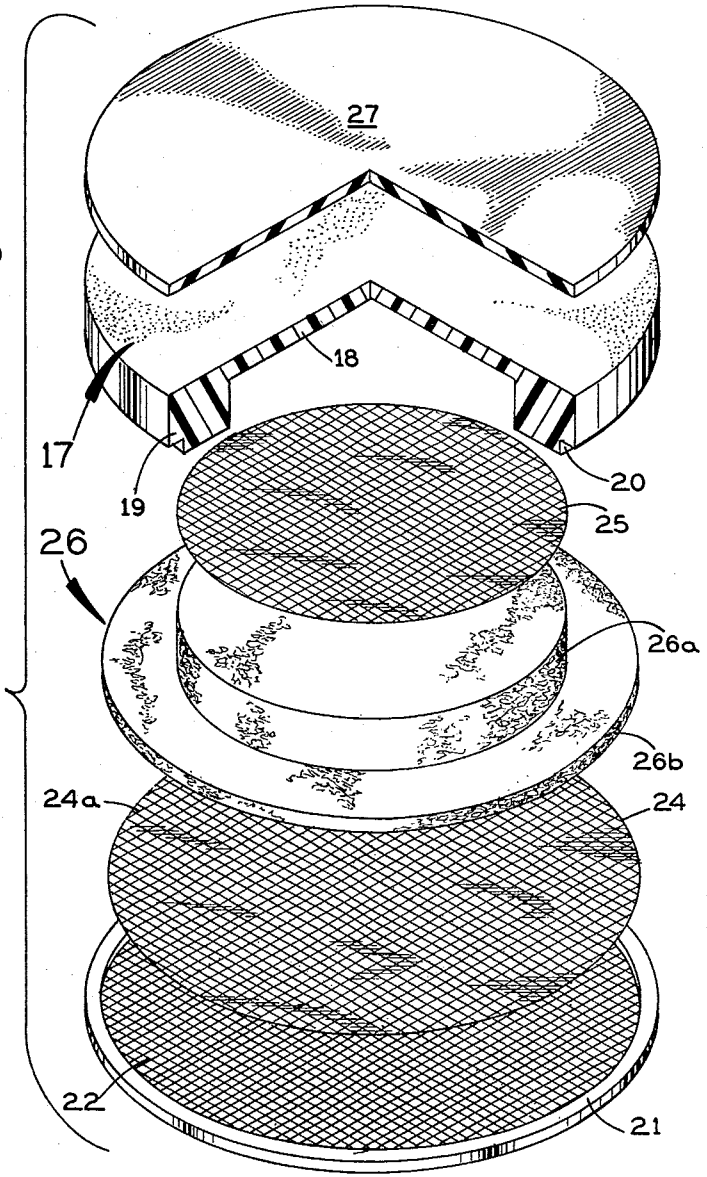
FIG. 2 is an exploded perspective view of the screened holder and the absorbent pad unit in FIG. 1.

The pad and holder assembly 10 is shown in detail in the exploded perspective view of FIG. 2. It includes a rigid, inverted, dished upper holder member 17 of suitably strong, impact-resistant plastic or metal. This holder member has a flat top wall 18 of circular outline and a peripheral flange 19 of substantial vertical and radial thickness extending down from the top wall 18. At the bottom on the outside, this flange is formed with a peripheral recess 20 of rectangular cross-section.

The bottom of the holder consists of a peripheral ring 21 and a coarse mesh screen 22, which preferably are molded in a single piece of suitable plastic which does not tend to develop an electrostatic charge due to triboelectricity when rubbed across a carpet. The marginal ring 21 projects above the screen 22, as best seen in FIG. 3, and it has a rectangular cross-section substantially complementary to the cross-section of groove 20 in holder member 17 so that it fits snugly in this groove.

Figure 3:
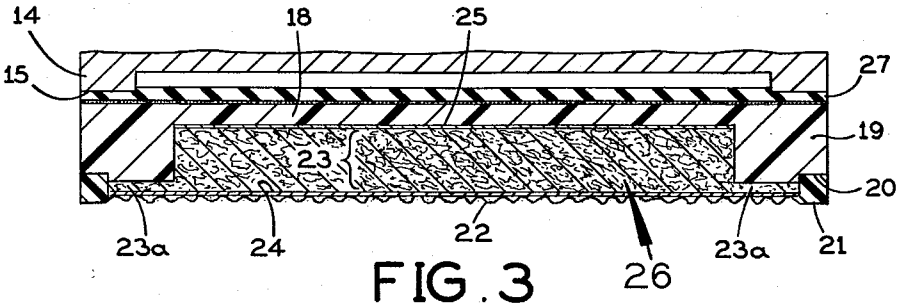
FIG. 3 is a fragmentary vertical cross-section taken along the line 3—3 in FIG. 1 and showing the holder and pad assembly beneath the buffing machine.

When the bottom piece 21, 22 fits on the holder member 17 as shown in FIG. 3, a circular recess 23 of substantial vertical depth is formed between the top wall 18 of holder member 17 and the screen 22 below. In addition, bordering the recess 23 an annular recess 23*a* of shallow vertical depth is formed between the bottom of the flange 19 on holder member 17 and the screen 22.

These connecting recesses are filled by an absorbent pad having a circular outer bottom sheet 24 of highly absorbent paper which is resistant to mild acids and is reinforced with fiberglass strands 24*a* embedded in the paper, a circular, inner top sheet 25 of the same construction as the bottom sheet, and sandwiched between the top and bottom sheets a relatively thick core 26 of cellullosic fluff made from wood pulp, multiple layers of cellulose wadding, absorbent cotton or rayon fibers or other highly absorbent material. For most of its vertical depth, as shown at 26*a* in FIG. 2, the absorbent core has a snug, sliding fit in the recess 23 between holder member 17 and the bottom screen 22. At the bottom the core 26 has a vertically thin, annular marginal flange 26*b* which is snugly received between the bottom of the holder flange 19 and screen 22, with a snug sliding fit inside the ring 21 surrounding the screen 22. The inner top sheet 25 of the absorbent pad has a snug, sliding fit inside the holder recess 23. The outer bottom sheet 24 has a snug, sliding fit inside ring 21.

The bottom and top sheets 24 and 25 and the core 26 of the absorbent pad are suitably bonded together to form a unitary assembly which may be conveniently handled as a single replaceable unit.

A friction pad 27 of natural or synthetic rubber or other suitable wear-resistant, frictional material is adhesively bonded to the top face of the upper holder member 17 and extends completely across it. This pad 27 is frictionally engageable by the teeth 15 on the buffing machine's drive block 14 when the weight of the head 11 of the machine rests on the present holder and pad assembly 10, as shown in FIG. 1.

The upper holder member 17, frictional pad 27, and bottom ring 21 and screen 22 are permanent parts of the present assembly. The absorbent pad unit, consisting of the top sheet 25, core 26 and bottom sheet 24, is a replaceable part of the present assembly which requires replacement from time to time because it becomes soaked with cleaning residue which it absorbs from the carpet.

This holder and pad assembly is positioned below the motor-driven drive block 14 on the head 11 of the floor buffing machine and rotates in unison with it as the buffing machine is moved slowly across a carpet to which has been applied previously a cleaning compound in liquid form containing an ingredient which effervesces when agitated. The screen 22 on the bottom of the holder rubs across the carpet and causes the cleaning compound to effervesce and penetrate down into the carpet for more effective cleaning action. Dirt and other residue from this cleaning operation is absorbed through the outer, bottom layer 24 into the absorbent core 26. Also, soap or detergent that may have remained in the carpet from previous cleanings will be soaked up by the absorbent pad.

When the drive motor 13 in the buffing machine begins to act as if the load on it is excessive, this indicates to the user that the absorbent pad 24, 25, 26 has soaked up enough residue that it should be replaced by a clean, dry pad.

FIGS. 4–6

Figure 4:
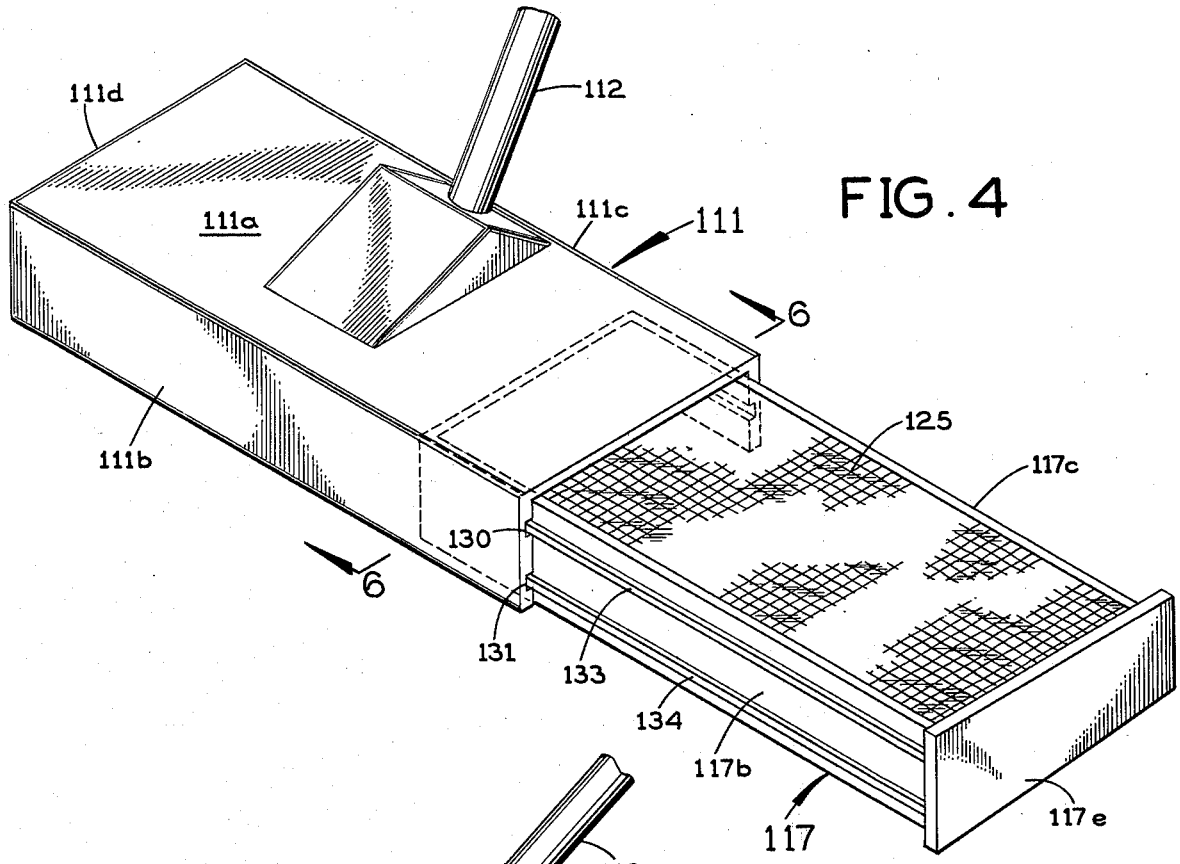
FIG. 4 is a fragmentary perspective view showing the cleaning head of a manually-operated carpet cleaning tool with a holder and absorbent pad assembly in accordance with a second embodiment of this invention partly removed from this head.
Figure 6:
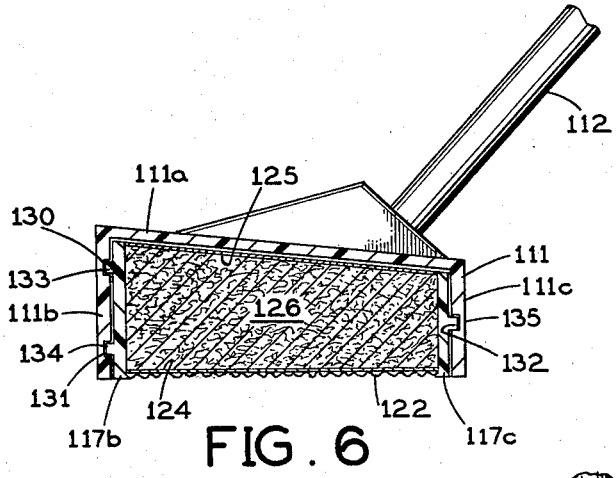
FIG. 6 is a vertical cross-section taken along the line 6—6 in FIG. 4.
Figure 5:
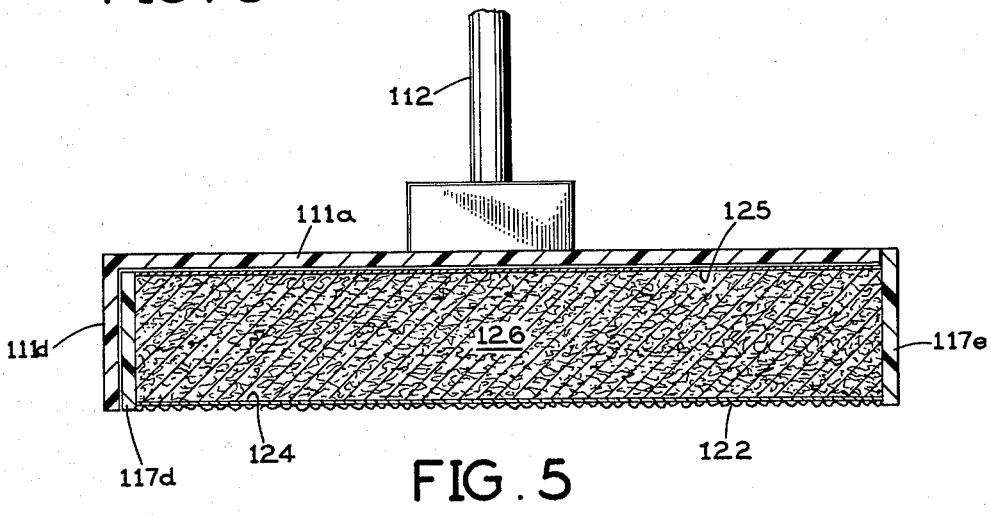
FIG. 5 is a vertical longitudinal section through this cleaning head with the holder and pad assembly fully inserted.

FIGS. 4–6 show a second embodiment of the invention in which the head of the carpet cleaning tool is a channel-shaped body 111 attached to the lower end of an elongated handle 112. The body 111 has a flat top wall 111*a*, which is inclined downward to the right in FIG. 4, as best seen in FIG. 6, a vertical side wall 111*b* extending down from the top wall at its left side in FIGS. 4 and 6, and a shorter vertical side wall 111*c* extending down from the top wall at its right side in FIGS. 4 and 6. The longer side wall 111*b* is formed with upper and lower horizontal grooves 130 and 131, which face inward and extend the full length of this wall. The shorter side wall 111*c* is formed with a single horizontal groove 132, which faces inward and extends the full length of this wall. The body 111 is open at its front end in FIG. 4 and is closed by a vertical end wall 111*d* (FIG. 5) at its opposite end.

The holder and pad assembly in this embodiment of the invention includes a tray-like holder 117 having opposite, parallel, vertical side walls 117*b* and 117*c*, a vertical inner end wall 117*d* (FIG. 5) extending perpendicularly between the side walls at one end, and a vertical outer end wall 117*e* extending perpendicularly between the side walls at the opposite end. The inner end wall 117*d* of the holder is slightly smaller than the generally rectangular downwardly-facing recess defined by the head 111. The holder side wall 117*b* has horizontal outwardly projecting, upper and lower ribs 133 and 134, which are slidably received respectively in the grooves 130 and 131 on the inside of the side wall 111*b* of the head 111. The holder side wall 117*c* has a horizontal, outwardly projecting rib 135 which is slidably received in the groove 132 on the inside of the side wall 111*c* of the head. With this arrangement, the holder is slidably insertable into and removable from the open end of the head 111. The outer end wall 117*e* of the head projects above, below and laterally beyond the side walls 117*b* and 117*c* at the open end of the head 111 so that it abuts against the top wall 111*a* and side walls 111*b* and 111*c* of the head at its open end when the holder is fully inserted into the head, as shown in FIG. 5. The inner end wall 117*d* of the holder extends contiguous to the end wall 111*d* at the closed end of the head 111.

On the bottom the holder 117 carries a horizontally disposed coarse mesh screen 122 (FIGS. 5 and 6) which extends between its side walls 117*b* and 117*c* and between its end walls 117*d* and 117*e* and is bonded to these walls in any suitable fashion.

The holder 117 carries an absorbent pad having a thin, outer, bottom sheet 124 of absorbent mildly acid-resistant paper with fiberglass reinforcing strands embedded therein, a thin inner, top sheet 125 of the same construction, and a relatively soft, thick, absorbent core 126 sandwiched between these sheets and bonded to both of them. This core is composed of any suitable highly absorbent material, such as cellulosic fluff made from wood pulp, multiple layers of cellulose wadding, absorbent cotton or rayon fibers. The absorbent pad 124–126 is insertable and removable as a unit into and from the holder 117. As shown in FIG. 6, in cross-section the absorbent pad is complementary to the recess in the holder above its bottom screen 122, with the top sheet 125 of the pad being inclined downward to the right in FIG. 6 so as to extend substantially coplanar with or slightly below the top edges of the holder side walls 111*b* and 111*c*.

The user of the tool first deposits in the carpet a liquid cleaning solution containing an effervescing or foaming ingredient. Then, using the handle 112, the user pushes the head 111 back and forth across the carpet with the screen 122 on the holder 117 rubbing the carpet to cause the cleaning solution to effervesce and penetrate down into the carpet. Dirt and other residue of the cleaning operation is absorbed by the pad 124, 125, 126. When required, a used absorbent pad may be removed by first sliding the holder 117, 122 out of the head 111 and then taking out the pad and putting in a clean, dry pad of the same type.

FIGS. 7–9

Figure 7:
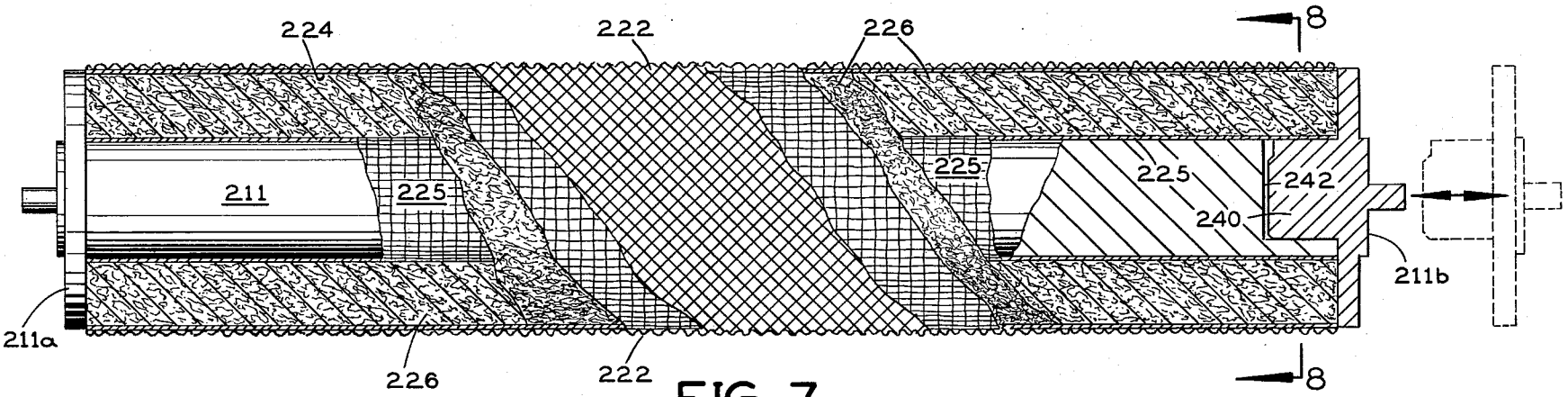
FIG. 7 is a longitudinal section through a holder and pad assembly in accordance with a third embodiment of the invention, in which the assembly is part of a carpet-engaging roller for the pickup head of a vacuum cleaner.
Figure 9:
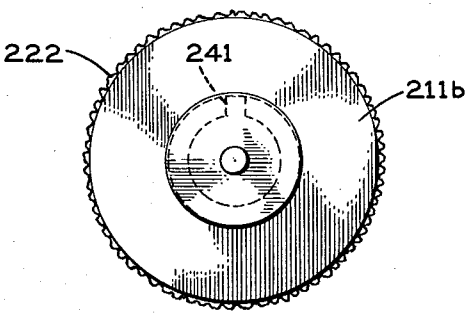
FIG. 9 is an elevational view showing the right end of the FIG. 7 arrangement.
Figure 8:
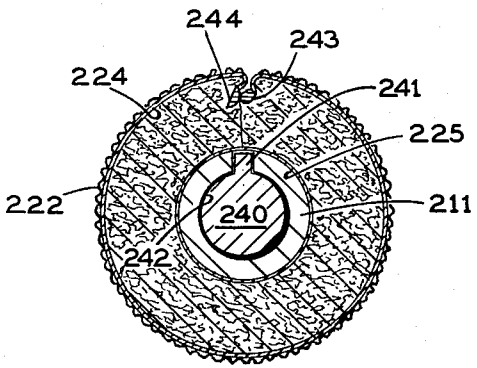
FIG. 8 is a vertical cross-section taken along the line 8—8 in FIG. 7.

FIGS. 7–9 show a third embodiment of the invention in which the holder for the absorbent pad is a roller on the pickup head of a vacuum cleaner. The vacuum cleaner may be of the upright type, with its motor on the pickup head at the lower end of a handle, or it may be of the tank or canister type in which the motor is in a tank or canister connected through a flexible hose to the upper end of a hollow handle or "wand" which has the pickup head at its lower end.

Referring to FIG. 7, this roller includes a central rotatable shaft 211 extending between an end piece 211*a* affixed to one end of the shaft and a removable end piece 211*b* on the opposite end. As shown in FIGS. 7 and 8, the removable end piece has an axial projection 240 on its inner end which is cylindrical for most of its extent and has a radially projecting rib 241 at one location on its periphery. This projection on the end piece fits snugly in a complementary keyhole-shaped recess 242 formed in this end of the roller shaft 211.

The holder for the absorbent pad also includes a wrap-around, coarse mesh screen 222 extending between the end pieces 211*a* and 211*b* of the roller.

The wrap-around absorbent pad includes a thin outer sheet 224 of acid-resistant, absorbent paper with fiberglass reinforcing strands embedded therein and fitting slidably just inside the screen 222. The pad also has a thin inner sheet 225 of the same material as the outer sheet 224 concentrically disposed inside the outer sheet 224 and fitting closely around the roller shaft 211. Sandwiched between the outer and inner sheets 224 and 225 is a relatively thick, soft core 226 of highly absorbent material, such as cellulosic fluff from wood pulp, multiple layers of cellulose wadding, absorbent cotton or rayon fibers.

The pad 224, 225, 226 is wrapped circumferentially around the roller 211 to bring the opposite ends of the pad close together at one circumferential location on the roller, but with a slight circumferential gap between them. The outer screen 222 is wrapped around the outside of the pad, and the opposite ends of the screen are positioned in the circumferential gap of the pad. On one side of this gap (FIG. 8) is a fixed rod 243 extending longitudinally of the roller between the end pieces 211*a* and 211*b*. On the opposite side of this gap is a rotatably adjustable locking cam 244, which extends longitudinally of the roller, with its opposite ends rotatably supported by the end pieces 211*a* and 211*b*. This cam is turned to clamp the ends of the screen 222 tightly against rod 243, thereby closing the screen around the pad 224–226 and tightening the pad itself on the roller shaft 211.

After first applying an effervescing cleaning solution to the carpet, the vacuum cleaner is pushed across the carpet, with the screen 222 on the roller rubbing across the carpet to cause the cleaning solution to effervesce or foam for more effective penetration into the carpet. Dirt and other cleaning residue is absorbed by the pad 224–226 on the roller.

I claim:

1. For use with a carpet cleaning apparatus having a handle and a head at the lower end of the handle to be guided across the carpet being cleaned, the improvement which comprises:

an absorbent pad unit having a thin outer sheet of fiber-reinforced absorbent material, an inner sheet, and a core of soft absorbent material sandwiched between said outer and inner sheets for soaking up moisture passing through said outer sheet;

a coarse mesh screen covering said outer sheet of said absorbent pad unit;

and means for mounting said absorbent pad unit and screen on said head of the carpet cleaning apparatus to position said screen in rubbing engagement with the carpet.

2. Apparatus according to claim 1, wherein said outer sheet of the absorbent pad unit is of acid-resistant, high absorbency paper with reinforcing fibers embedded therein.

3. Apparatus according to claim 1, wherein both said inner sheet and said outer sheet of the absorbent pad unit are of acid-resistant, high absorbency paper with reinforcing fibers embedded therein.

4. Apparatus according to claim 1, wherein said means for mounting comprises:

a holder circumferentially enclosing and overlying said absorbent pad unit and carrying said screen below said outer sheet of the pad unit;

and a frictional pad on top of said holder for engagement by an overlying motor driven rotary drive block in said head.

5. Apparatus according to claim 4, wherein said outer sheet is of acid resistant, high absorbency paper with reinforcing fibers embedded therein.

6. Apparatus according to claim 5, wherein:

said inner sheet is at the top of said absorbent pad inside said holder;

said outer sheet is at the bottom of said absorbent pad at the bottom of said holder, and said outer sheet projects laterally beyond the periphery of said inner sheet throughout the latter's extent;

and said absorbent core at its lower end projects laterally beyond the periphery of said inner sheet for a short vertical distance directly above said outer sheet to form therewith an annular peripheral flange at the bottom of the absorbent pad.

7. Apparatus according to claim 1, wherein:

said meanss for mounting includes a holder member removably mounted in said head and defining a recess which snugly receives said absorbent pad unit with said outer sheet of the pad unit at the bottom;

and said screen extends across the bottom of said holder directly below said outer sheet of the pad unit.

8. Apparatus according to claim 7, wherein said holder is open at the top for the insertion and removal of said absorbent pad unit into and out of said recess in the holder when the holder is removed from said head.

9. Apparatus according to claim 8, wherein said holder is slidably mounted in said head.

10. Apparatus according to claim 7, wherein said holder is slidably mounted in said head and defines an opening through which said absorbent pad unit may be inserted into and removed from said recess in the holder.

11. Apparatus according to claim 7, wherein said outer sheet of the absorbent pad unit is of acid-resistant, high absorbing paper with reinforcing fibers embedded therein.

12. Apparatus according to claim 1, wherein:

said means for mounting is a rotatable horizontal shaft on the bottom of a vacuum cleaner pickup head;

said absorbent pad unit extends circumferentially around said shaft;

and said screen extends circumferentially around said pad unit next to said outer sheet of the latter.

13. Apparatus according to claim 12, wherein said outer sheet of the absorbent pad unit is of acid-resistant, high absorbency paper with reinforcing fibers embedded therein.

* * * * *